US005395421A

United States Patent [19]

Weinl et al.

[11] Patent Number: 5,395,421

[45] Date of Patent: Mar. 7, 1995

[54] TITANIUM-BASED CARBONITRIDE ALLOY WITH CONTROLLED STRUCTURE

[75] Inventors: Gerold Weinl, Alvsjo; Rolf Oskarsson, Ronninge; Lars Hultman, Johanneshov, all of Sweden

[73] Assignee: Sandvik AB, Sandviken, Sweden

[21] Appl. No.: 128,656

[22] Filed: Sep. 30, 1993

[30] Foreign Application Priority Data

Sep. 30, 1992 [SE] Sweden ..... 9202837

[51] Int. Cl.[6] ..... C22C 29/04; C22C 29/08; C22C 29/10

[52] U.S. Cl. ..... 75/238; 75/239; 75/240; 75/242; 75/241; 75/244

[58] Field of Search ..... 75/238, 242, 239, 240, 75/241, 244

[56] References Cited

U.S. PATENT DOCUMENTS

| | | | |
|---|---|---|---|
| 3,971,656 | 7/1976 | Rudy | 75/203 |
| 4,775,521 | 10/1988 | Siddon et al. | 423/561 R |
| 4,904,445 | 2/1990 | Iyori et al. | 419/3 |
| 4,957,548 | 9/1990 | Shima et al. | 75/238 |
| 5,308,376 | 5/1994 | Oskarsson | 75/238 |

OTHER PUBLICATIONS

Patent Abstracts of Japan, unexamined applications, C field, vol. 12, No. 15, Jan. 16, 1988, The Patent Office Japanese Government, p. 62 C 469, No. 62-170 452 (Hitaci).

Patent Abstracts of Japan, unexamined applications, C field, vol. 16, No. 581, Dec. 21, 1992, The Patent Office Japanese Government, p. 87 C 1012, No. 04-231 467 (Kyocera).

Patent Abstracts of Japan, unexamined applications, C field, vol. 13, No. 111, Mar. 16, 1989, The Patent Office Japanese Government, p. 96 C 577, No. 63-286 549 (Toshiba).

Patent Abstracts of Japan, unexamined applications, C field, vol. 13, No. 111, Mar. 16, 1989, The Patent Office Japanese Government, p. 96 C 577, No. 63-286 550 (Toshiba).

Chemical Abstracts, vol. 111, No. 8, Aug. 21, 1989, Columbus, Ohio, USA, T. Saito et al, "Titanuim Carbide-Base Sintered Alloys With High Resistance To Thermal Deformation", p. 281, col. 1, abstract No. 62 361n & Jpn. Kokai Tokkyo Koho JP 63-286 550.

Chemical Abstracts, vol. 111, No. 8, Aug. 21, 1989, Columbus, Ohio, USA, U. Kozo et al, "Titanium Carbide Base Sintered Alloys With High Resistance to Plastic Deformation", p. 280, col. 2, abstract No. 62 360m & Jpn. Kokai Tokkyo Koho JP 63-286 549.

Chemical Abstracts, vol. 103, No. 4, Jul. 29, 1985, Columbus, Ohio, USA, Mitsubishi Metal Corp., "Sintered Hard Tungsten Carbide Alloys As Cutting Tools", p. 218, col. 2, abstract No. 25 982e & Jpn. Kokai Tokkyo Koho JP 60-39 138.

Chemical Abstracts, vol. 118, No. 4, Jan. 25, 1993, Columbus, Ohio, USA, H. Konishi, "Tools from Titanium Carbonitride Cermet", p. 257, col. 2, abstract No. 26 153g & Jpn. Kokai Tokkyo Koho JP 04-231 467 (920231 467).

*Primary Examiner*—Donald P. Walsh
*Assistant Examiner*—Ngoclan T. Mai
*Attorney, Agent, or Firm*—Burns, Doane, Swecker & Mathis

[57] ABSTRACT

There now exists a sintered titanium-based carbonitride alloy containing hard constituents with core-rim structure based on, besides Ti, W, one or more of the metals Zr, Hf, V, Mo, Nb, Ta or Cr in 5-30 weight % binder phase based on Co and/or Ni with simultaneously increased wear resistance and toughness. The alloy is characterized in that at least 70%, preferably at least 80%, of said hard constituents have four different types of cores with the following contents of Ti and W in weight % of the total metal content: 1-5 W and 90-95 Ti (1A), 15-25 W and 65-85 Ti (1B), 50-75 W and 20-40 Ti (1C), as well as 20-30 W and 30-60 Ti (2A), whereby the amount of each type is at least 5%.

6 Claims, 1 Drawing Sheet

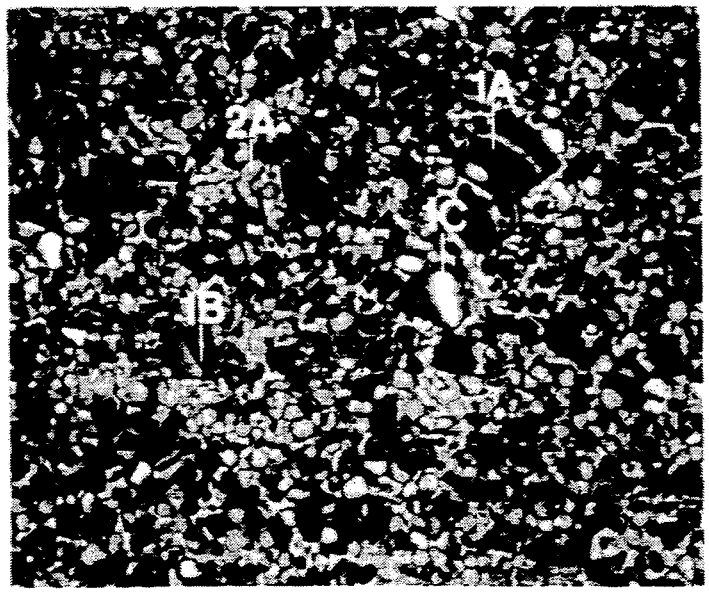
2A
1A
1C
1B

TITANIUM-BASED CARBONITRIDE ALLOY WITH CONTROLLED STRUCTURE

BACKGROUND OF THE INVENTION

The present invention relates to a sintered carbonitride alloy with titanium as the main component which simultaneously has obtained improved toughness behavior and increased wear resistance and resistance against plastic deformation.

Classic cemented carbide, i.e., based on tungsten carbide (WC) and cobalt (Co) as binder phase, has in the last few years met increased competition from titanium-based hard materials, usually called cermets. In the beginning, these alloys were used only for extreme finishing due to their extraordinary wear resistance at high cutting temperatures. This property depends primarily upon the good chemical stability of these titanium alloys. The toughness behavior and the resistance against plastic deformation were not satisfactory however, and therefore the area of application was relatively limited.

Development has, however, proceeded and the area of application for titanium-based hard material has been considerably enlarged. The toughness behavior and the resistance to plastic deformation has been considerably improved. This has been done, however, by partly sacrificing the wear resistance.

Besides titanium, the other metals from groups IVa, Va and VIa of the periodic table, i.e., Zr, Hf, V, Nb, Ta, Cr, Mo and/or W are normally used as hard constituent formers generally as carbides, nitrides and/or carbonitrides. The grain size of the hard constituents is generally $<1$ μm. As binder phase nowadays often both cobalt and nickel are used. The amount of binder phase is generally 3–25 weight %.

During sintering, the relatively less stable hard constituents are dissolved in the binder phase and precipitate then as a rim on the more stable hard constituents. A very common structure in alloys in question is therefore hard constituent grains with a core-rim structure. A patent in this area is U.S. Pat. No. 3,971,656 which comprises Ti- and N-rich cores surrounded by rims rich in Mo, W and C. Through U.S. patent application Ser. No. 07/543,474 (our reference: 024000-757), it is known that at least two different combinations of duplex core-rim structures in well-balanced proportions give optimal properties with regard to wear resistance, toughness behavior and/or resistance against plastic deformation. Further examples of patents in this area are U.S. Pat. Nos. 4,904,445; 4,775,521; and 4,957,548.

OBJECTS AND SUMMARY OF THE INVENTION

It is an object of this invention to avoid or alleviate the problems of the prior art.

It is further an object of this invention to provide a sintered carbonitride alloy with titanium as the main component which has improved toughness behavior and increased wear resistance and resistance against plastic deformation.

In one aspect of the invention there is provided a sintered titanium-based carbonitride alloy containing hard constituents with a core-rim structure said alloy comprising carbides, nitrides or carbonitrides of Ti, W, and at least one metal taken from the group consisting of Zr, Hf, V, Nb, Ta, Mo, Cr and mixtures thereof, in 5–30 weight % metallic binder phase of a metal taken from the group consisting of Co, Ni and mixtures thereof, at least 70% of said hard constituents having four different types of core-rim structure with the cores containing the following contents of Ti and W in weight % of the total metal content: 1–5 W and 90–95 Ti (type 1A); 15–25 W and 65–85 Ti (type 1B); 50–75 W and 20–40 Ti (type 1C); and 20–30 W and 30–60 Ti (type 2A), the amount of each type of cores being at least 5% of the total amount of hard constituent having a core-rim structure in the alloy.

In another aspect of the invention there is provided a method of manufacturing a sintered titanium-based carbonitride alloy containing hard constituents with core-rim structure besides Ti and W and/or Mo, one or more of the metals Zr, Hf, V, Nb, Ta or Cr in 5–30 weigh % binder phase on Co and/or Ni with powder metallurgical methods milling, pressing and sintering wherein essentially all tungsten is added as (Ti,W)(C,N) of the following composition: 18–22% W, 60–65% Ti, 11.5–12.2% C and 5.5–6.2% N.

BRIEF DESCRIPTION OF THE DRAWING

The Figure shows the structure of a sintered carbonitride alloy according to the invention in 4000× in which 1A, 1B and 1C and 2A are cores with different electron optical contrast and therefore different composition.

DETAILED DESCRIPTION OF THE PREFERRED EMBODIMENTS OF THE INVENTION

It has now turned out that if the structure contains cores of several different compositions of tungsten and titanium surrounded by rims of essentially the same composition, an increase in toughness without loss of wear resistance and resistance against plastic deformation is obtained.

According to the present invention, there is now provided an improved titanium-based carbonitride alloy containing hard constituents with a core-rim structure. At least 70%, preferably at least 80%, of said hard constituents have four different types of cores designated 1A, 1B, 1C and 2A in the figure surrounded by rims with essentially the same composition. The amount of each type of core amounts to at least 5%, preferably at least 10% of the total amount of hard constituents having a core-rim structure in the alloy.

The core type 1A comprises titanium, 90–95 weight %, as the hard constituent former and contains also 1–5 weight % W and only small amounts, $<3$ weight % of the remaining metallic elements. These cores are relatively large compared to the remaining cores and often measure around 1 μm, and even somewhat longer, in its longest dimension.

The core types 1B and 1C contain mainly titanium and tungsten as the metallic hard constituent formers and relatively low content of other metallic elements, $<5$ weight % each. The content of tungsten and titanium for type 1B is 15–25 weight % and 65–85 weight %, respectively. For type 1C, it is 50–75 weight %, preferably 55–70 weight %, tungsten and 20–40 weight %, preferably 30–45 weight %, titanium. The size of these cores is $<1$ μm.

Core type 2A contains 20–30 weight % tungsten and 30–60 weight %, preferably 35–55 weight %, titanium, but is considerably higher, in all 25–35 weight %, in its content of the remaining metallic alloying elements than the cores of types 1A–C. The core type 2A further has about the same content of alloying elements, in addition to titanium and tungsten, as the rims and, as compared to the other herein defined core types, a somewhat higher content of heavy elements, which together with the somewhat higher tungsten content is evident from the brighter contrast of the scanning electron microscope micrographs in the backscattered electron mode.

Core type 2A has the smallest size, generally about 0.5 μm or less. It is further the most frequent and constitutes about 50% or more of the total number of cores. The amount of 1A-cores is lower in the surface than in the inner portion of the material.

The rims around core types 1A–C arise primarily in connection with cooling after finished sintering, and consequently are essentially identical. Measured deviations lie within the error limits.

The rims around core type 2A are, in addition, not at all as developed as those around the other core types 1A–C. There is, however, no reason to assume that the thin rims around core type 2A should have another composition than the rims around core types 1A–C. They have clear epitaxy and around cores have as a result often angular rims. This is contrary to what normally is the case for known titanium-based carbonitride alloys.

Further core types, in addition to what has been defined above with associated rims, can also be present in the alloy according to the present invention up to 30%, preferably up to 20%, of the total number of cores.

It has turned out to be possible to alloy core types 1B and 1C with elements from group V of the periodic table, i.e., vanadium, niobium and tantalum, which can give further improvement of the resistance against plastic deformation. This possibility has, however, mainly marginal effects because core type 2A with high tantalum content is so frequent. This improvement of the resistance against plastic deformation is possible to obtain without serious deterioration of the toughness behavior.

Particularly good properties have been obtained for alloys with the following composition in weight %: WC 10–15, TiC+TiN 50–60, TaC<8, VC<5, $Mo_2C$<10, whereby however TaC+VC+$Mo_2C$<20 and Co+Ni 5–20, preferably 8–16.

A carbonitride alloy according to the present invention is manufactured by the powder metallurgical steps of milling, pressing and sintering. Powders forming the hard constituents and powders forming binder phase are mixed to a mixture of desired composition, and bodies are then pressed and sintered in accordance with conventional techniques. The special properties of the alloy according to the invention are obtained by adding essentially all tungsten and nitrogen as (Ti,W)(C,N) of the following composition in weight %: 18–22% W, 60–65% Ti, 11.5–12.2% C and 5.5–6.2% N.

The toughness increasing effect obtained in an alloy according to the present invention now makes it possible for titanium-based carbonitride alloys with a wear resistance and a related toughness behavior which earlier could only be used for extreme finishing under continuous engagement. Now with its maintained wear resistance, inserts of the present invention can be used even for intermittent machining and certain copying operations, i.e., with varying cutting depths. In addition, an increase in wear resistance on the rake face (i.e., the side of the insert on which the metal chip slides), is obtained in the form of an increased resistance against so-called crater wear.

The invention is additionally illustrated in connection with the following Examples which are to be considered as illustrative of the present invention. It should be understood, however, that the invention is not limited to the specific details of the Examples.

EXAMPLE 1

A powder mixture consisting of, in weight %, 13.7 WC, 40.8 TiC, 15.7 TiN, 6.2 TaC, 4.1 VC, 8.2 $Mo_2C$, 6.7 Co and 4.6 Ni was manufactured whereby all WC was added as (Ti,W)(C,N) of the composition 20% W, 62% Ti, 11.85% C and 5.85% N. Of the mixture, inserts of type TNMG 160408 QF were pressed which subsequently were sintered in 9 mbar Ar at 1430° C.

The structure in these inserts in shown in the figure which is a scanning electron microscope micrograph in so-called back scattered mode in 4000× magnification. In the figure, the following four types of cores with their contrast can be distinguished:

| CORE TYPE | CONTRAST |
|---|---|
| 1A | black |
| 1B | grey |
| 1C | white |
| 2A | light grey |

The metal content of these cores and in the rims associated with resp core type as well as of the composition of the binder phase have been determined with energy dispersive technique and put together in Table 1 below. Because core type 2A has a considerably thinner and more diffuse rim than the cores of type 1A–C, no reliable analysis has been obtained. There is, however, no reason to believe that the rims around core type 2A should have another composition than the rims around core types 1A–C.

TABLE 1

| Type of Structure | Compositions in weight % of the total metal content averages | | | | | | |
|---|---|---|---|---|---|---|---|
| Elements | Ti | V | Co | Ni | Mo | Ta | W |
| Core, 1A | 92.2 | 0.3 | 0.6 | 0.4 | 1.5 | 2.0 | 3.3 |
| Core, 1B | 75.6 | 0.9 | 0.5 | 0.3 | 2.4 | 3.0 | 17.6 |
| Core, 1C | 29.2 | 1.0 | 0.6 | 0.2 | 2.0 | 2.6 | 64.4 |
| Core, 2A | 46.6 | 5.5 | 2.1 | 1.2 | 11.5 | 9.7 | 23.4 |
| Rim, 1A | 59.0 | 3.5 | 0.7 | 0.5 | 9.2 | 9.2 | 18.0 |
| Rim, 1B | 57.5 | 3.9 | 1.0 | 0.6 | 8.7 | 9.3 | 19.0 |
| Rim, 1C | 57.9 | 3.7 | 1.7 | 1.0 | 7.9 | 8.8 | 19.1 |
| Rim, 2A | cannot be analyzed, too thin | | | | | | |
| Binder Phase | 5.7 | 2.6 | 43.2 | 27.5 | 8.1 | 2.5 | 10.4 |

From Table 1, it is evident that the rims around core types 1A–C are as identical as one can desire, i.e., the deviations lie within the error limits, which is why they are to be regarded as if they have the same composition. This agrees well with the content of titanium as well as of heavy elements.

From Table 1, it is further evident that core type 1A mainly contains titanium as a metallic element and that types 1B and 1C have different Ti- and W-content, but the remaining metallic elements are the same. Core type 2A contains considerably more of the remaining metallic elements than the three other core types. That the rims contain somewhat more tungsten than core type 1B, but less than core type 2A, depends on how the average composition of the actual carbonitride alloy has been chosen and is consequently not characteristic for the invention as such.

EXAMPLE 2

Two different commercially available titanium-based carbonitride alloys, one of a wear resistant type and intended for finishing, and the other of a tougher type intended also for intermittent machining and copying operations were compared with an alloy according to Example 1. The same insert type was used, namely TNMG 160408 QF. The edge radius was the same for all inserts.

The wear resistance was tested in a facing operation of tubes SS2234. The tube diameter was $D_o$=95 mm and $D_i$=50 mm.

Cutting data:

Speed=400 m/min

Feed=0.15 mm/rev

Cutting depth=0.5 mm

The following result was obtained expressed as relative life to the same degree of flank wear, $V_B$, alternatively failure:

| | Relative Life To | |
|---|---|---|
| | $V_b$ | Failure |
| According to the invention | 1.0 | 1.1 |
| Wear resistant grade | 1.0 | 1.0 |
| Tough grade | 0.4 | 0.6 |

Toughness was tested in an intermittent turning operation in SS2244-05. The following cutting data were used:

Speed=110 m/min

Feed=0.10 mm/rev

Cutting depth=1.5 mm

Result expressed in percent victories compared to the reference which was the wear resistant grade:

| | Percent Victories |
|---|---|
| According to the invention | 90 |
| Tough grade | 93 |
| Wear resistant grade (reference) | 50 |

The example shows that an alloy according to the invention has the same toughness as the tough grade and simultaneously the same wear resistance as the wear resistant one.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A sintered titanium-based carbonitride alloy containing hard constituents with a core-rim structure said alloy comprising carbides, nitrides or carbonitrides of Ti, W, and at least one metal taken from the group consisting of Zr, Hf, V, Nb, Ta, Mo, Cr and mixtures thereof, in 5–30 weight % metallic binder phase of a metal taken from the group consisting of Co, Ni and mixtures thereof, at least 70% of said hard constituents having four different types of core-rim structure with the cores containing the following contents of Ti and W in weight % of the total metal content: 1–5 W and 90–95 Ti (type 1A); 15–25 W and 65–85 Ti (type 1B); 50–75 W and 20–40 Ti (type 1C); and 20–30 W and 30–60 Ti (type 2A), the amount of each type of cores being at least 5% of the total amount of hard constituent having a core-rim structure in the alloy.

2. The titanium-based carbonitride alloy of claim 1 wherein the rims of said four types of core-rim structures have essentially the same composition.

3. The titanium-based carbonitride alloy of claim 1 wherein core-rim type 2A has a size <0.5 μm and the amount of said type is at least 50% of the total amount of hard constituent in the alloy.

4. The titanium-based carbonitride alloy of claim 1 wherein the alloy has the following overall composition in weight %: WC 10–15, TiC+TiN 50–60, TaC <8, VC<5, $Mo_2C$<10, whereby however TaC+VC+$Mo_2C$<20 and the amount of metallic binder is from 5–20 weight %.

5. The titanium-based carbonitride alloy of claim 1 wherein said four types of hard constituents comprise at least 80% of the total amount of hard constituent in the alloy.

6. The titanium-based carbonitride alloy of claim 1 wherein the amount of metallic binder is 8–16 weight %.

* * * * *